United States Patent [19]

Intardonato

[11] Patent Number: 4,708,256

[45] Date of Patent: Nov. 24, 1987

[54] TABLE TRAY

[76] Inventor: Alfred J. Intardonato, 59 Barker Dr., Stony Brook, N.Y. 11790

[21] Appl. No.: 885,741

[22] Filed: Jul. 21, 1986

Related U.S. Application Data

[63] Continuation of Ser. No. 707,740, Mar. 4, 1985, abandoned.

[51] Int. Cl.[4] ..... B65D 21/02

[52] U.S. Cl. ..... 220/23.4; 220/4 B; 220/4 C; 220/23.83

[58] Field of Search ..... 220/23.2, 23.4, 23.8, 220/23.83, 18.22, 20, 4 B, 4 D, 4 C, 4 E, 4 F

[56] References Cited

U.S. PATENT DOCUMENTS

| | | | |
|---|---|---|---|
| 447,221 | 2/1891 | Wiggers | 220/23.4 |
| 986,396 | 3/1911 | King | 220/23.4 |
| 2,566,804 | 9/1951 | Flamme et al. | 220/23.4 |
| 2,939,248 | 6/1960 | Beck | 220/4 E |
| 3,473,754 | 10/1969 | Quenot | 220/4 E |
| 3,851,936 | 12/1974 | Muller | 220/23.4 |
| 4,219,693 | 8/1980 | French | 220/4 E |
| 4,385,695 | 5/1983 | Champlin et al. | 220/4 F |

FOREIGN PATENT DOCUMENTS

| | | | |
|---|---|---|---|
| 31334 | 11/1920 | Norway | 220/23.4 |

*Primary Examiner*—Joseph Man-Fu Moy
*Attorney, Agent, or Firm*—Frank R. Agovino

[57] ABSTRACT

First and second interlocking portions defining an aperture in which a support may be located. Each portion has a base and a first wall connecting to the base and having an engaging support such as a bayonnet lock. The portions are interlocked to form a container which may include radially extending, compartmental walls. A bearing assembly may be located under each base to permit rotation of the container about the support.

7 Claims, 10 Drawing Figures

TABLE TRAY

This application is a continuation of application Ser. No. 707,740 filed Mar. 4, 1985 which is now abandoned.

BACKGROUND OF THE INVENTION

1. Field of the Invention

The invention generally relates to a container which may be placed on top of a table and, in particular, to a table tray having an aperture therein for engaging a vertical support such as an umbrella stand.

2. Description of the Prior Art

Containers which may be placed on top of tables are well known in the prior art. However, such containers are not adapted to be placed in the center of tables having vertical umbrella stands passing therethrough. The invention addresses this problem.

SUMMARY OF THE INVENTION

It is an object of this invention to provide a table tray having an aperture therein for engaging a vertical support such as a vertical umbrella support.

It is another object of this invention to provide a container having two equally sized, symmetrical hemispherical portions which engage each other about a vertical support. It is another object of this invention to provide a container having compartmental walls which extend radially outward from an aperture defined within the center of the container.

The article according to the invention may be located about a support such as a vertical umbrella stand. The article includes first and second interlocking portions defining therebetween an aperture in which the support may be located. The first portion includes a first base having a notch in an edge thereof in which the support may be located. A first wall is connected to the first base and has first and second edges. First engaging means are supported by the first wall. The second portion includes a second base, and a second wall connected to the second base having first and second edges. Second engaging means supported by the second wall for engaging the first engaging means are also provided. The second base has an edge forming a closure around the notch which traps the support within the notch and between the first and second bases when the first engaging means engages the second engaging means. The first edge of the first wall is adjacent to the first edge of the second wall when the first engaging means engages the second engaging means. The second edge of the first wall is adjacent to the second edge of the second wall when the first engaging means engages the second engaging means. As a result, the first wall, the first base and the second wall and the second base form a container with the support projecting therethrough when the first engaging means engages the second engaging means and when the support is located in the notch.

These features and objects of the invention as well as others will become apparent to those skilled in the art by referring to the accompanying drawings, the following specification and the appended claims defining the scope thereof.

DETAILED DESCRIPTION OF THE INVENTION

Figure 1:
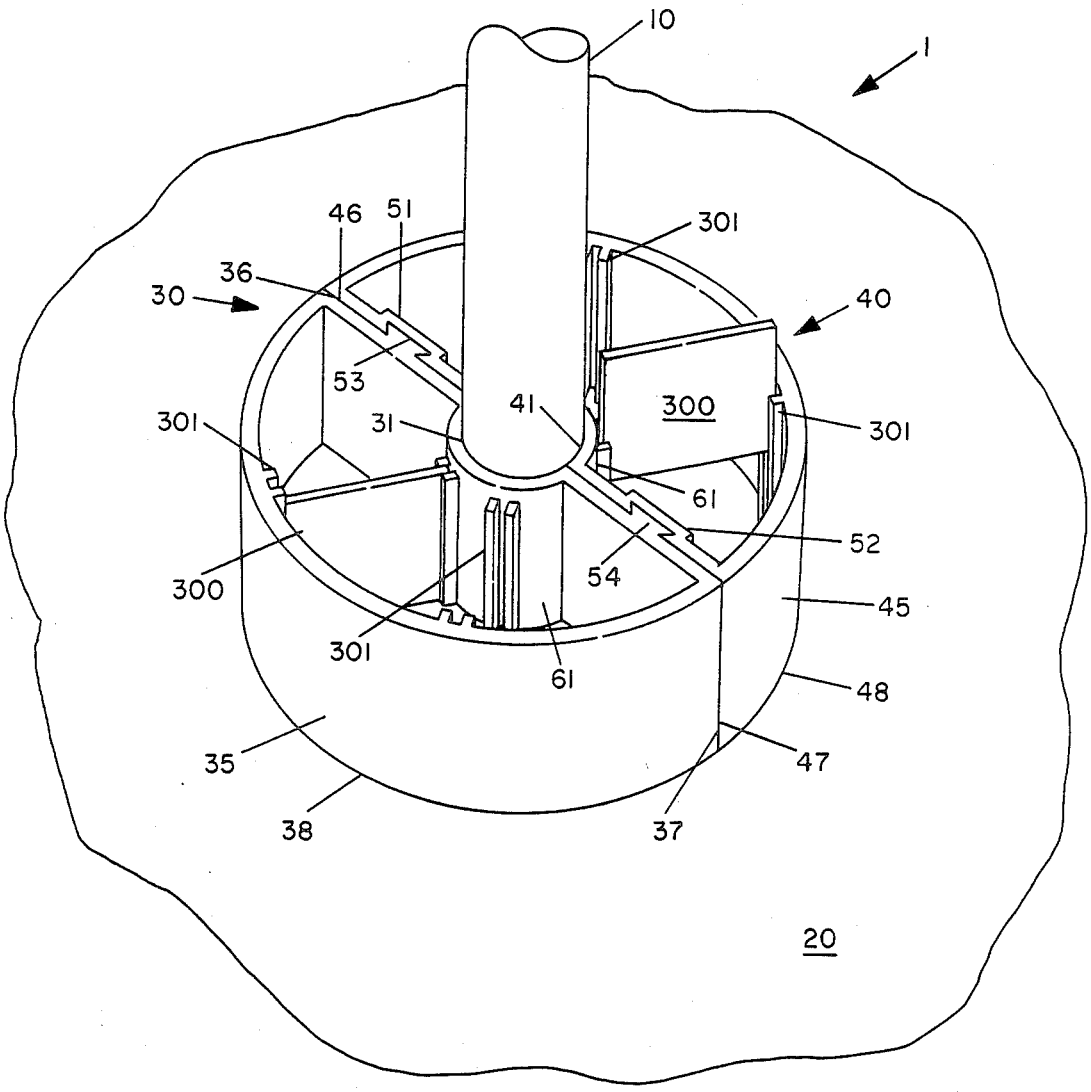
FIG. 1 is a perspective view of one embodiment of the table container according to the invention.
Figure 2:
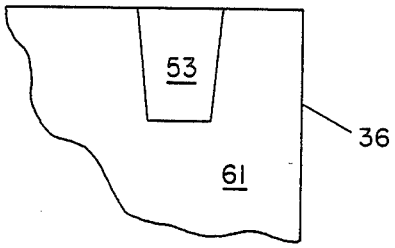
FIGS. 2 and 3 are front and top views of the male portion of the bayonnet lock shown in FIG. 1.
Figure 3:
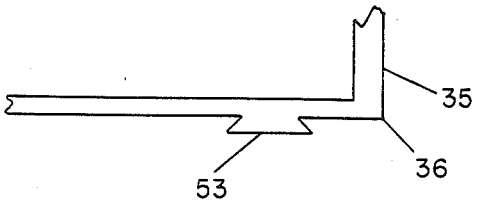
Figure 4:
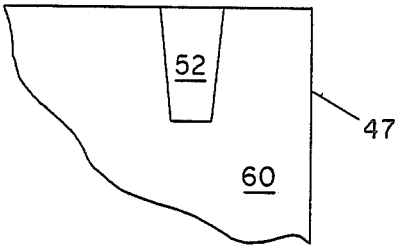
FIGS. 4 and 5 are front and top views, respectively, of the female portion of the bayonnet lock shown in FIG. 1.
Figure 5:
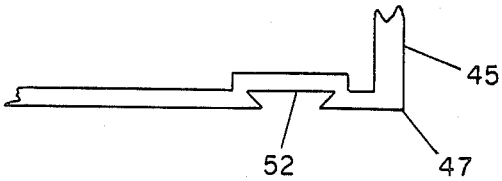
Figure 6:
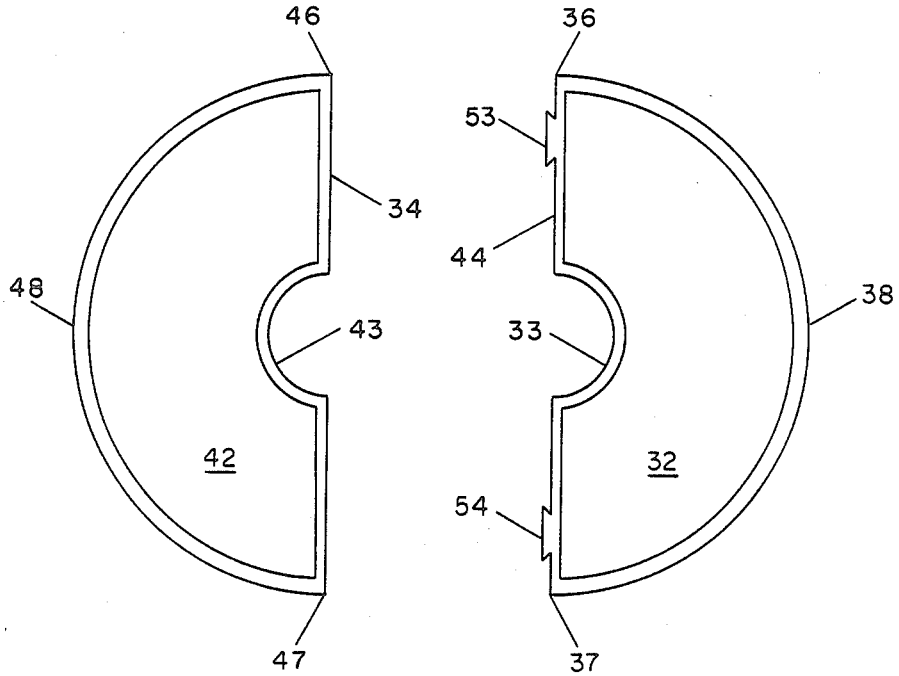
FIG. 6 is a bottom view of table container of FIG. 1.
Figure 7:
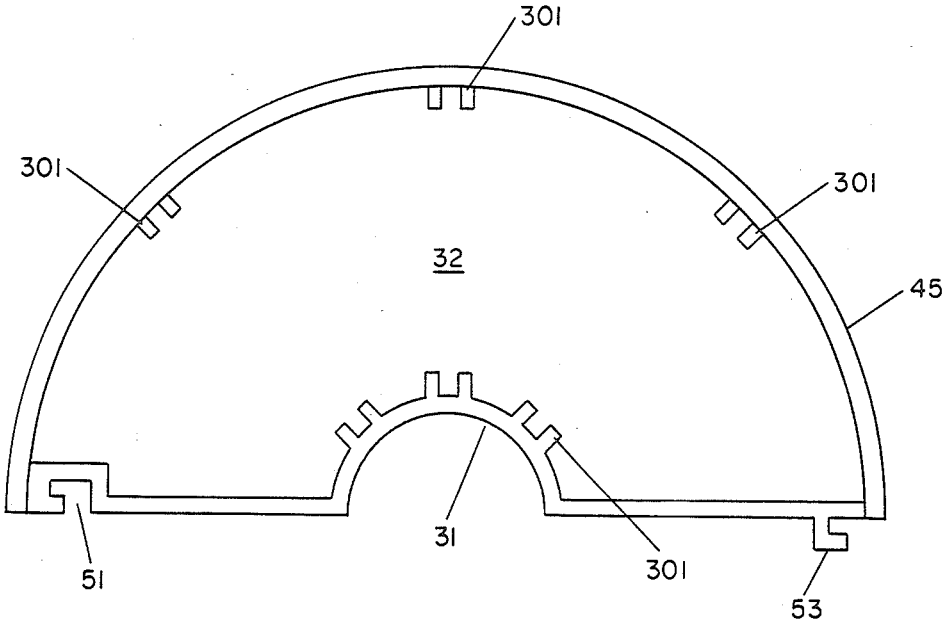
FIG. 7 is a top view of an alternate embodiment of one portion of the table container according to the invention.
Figure 8:
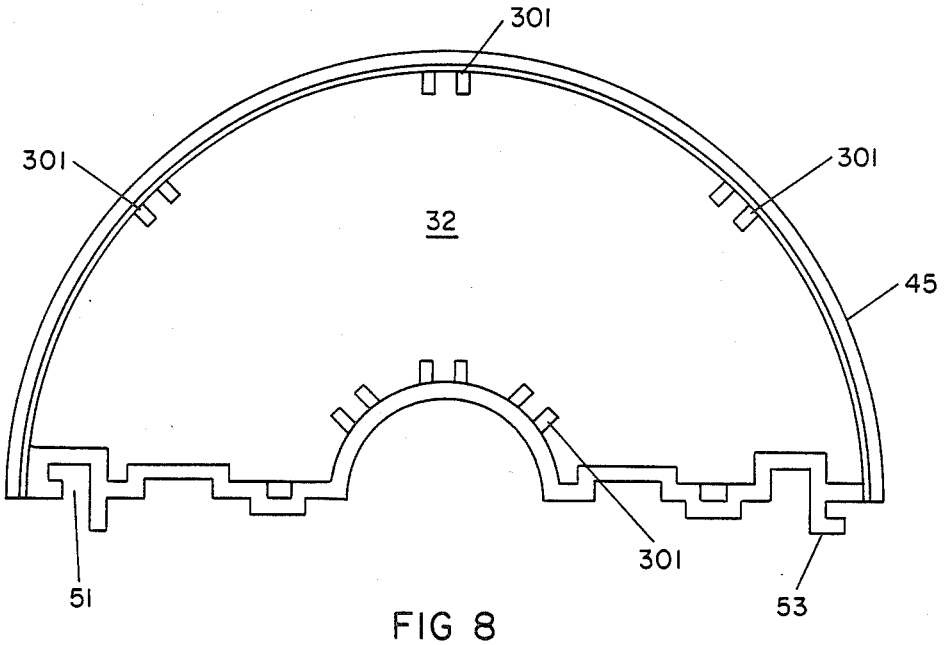
FIG. 8 is a top view of another alternate embodiment of a table container portion according to the invention.

Referring to FIG. 1, the article 1 according to the invention may be located about any vertical support such as vertical umbrella support 10 projecting through table top 20. The article 1 according to the invention includes a first interlocking portion 30 and a second interlocking portion 40 defining therebetween an aperture 31, 41, respectively in which support 10 may be located. Although interlocking portions 30 and 40 are shown as hemispherical, symmetrical portions having similar size and shape in FIG. 1 it is contemplated by the invention that such structural configurations are not limitations.

Figure 10:
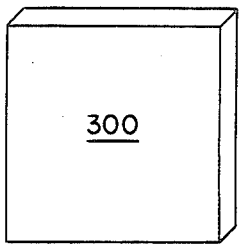
FIG. 10 is a perspective view of the compartmental wall used to define different compartments within the hemispherical portions of the table container according to the invention.

First portion 30 includes a first base having a notch in one edge thereof in which the support may be located. FIG. 10 is a bottom view of the article of FIG. 1 showing first base 32 including notch 33 therein along the edge 34 of the base. First portion 30 is provided with a first wall 35 which is connected to the base along edge 38 and has first and second edges 36, 37.

Second portion 40 includes a second base 42 which may have an opposing notch 43 in edge 44 thereof. Second portion 40 further includes a second wall 45 connected to the second base along edge 48 and having a first edge 46 and a second edge 47.

Both the first and second portions are provided with engaging means such as the bayonnet lock shown in FIGS. 2-5. A first engaging means in the form of a bayonnet slot 51, 52 is supported by inner wall 60 of second portion 40. A second engaging means in the form of bayonnet projection 53, 54 is supported by the inner wall 61 of the second portion 40. Bayonnet slots 51, 52 engage projections 53,54 to interlock portion 30 to portion 40 around support 10.

The second edge 37 of the first wall 35 is adjacent to the second edge 47 of the second wall 45 when the engaging means interlock portions 30 and 40. Similarly, the first edge 36 of the first wall 35 is adjacent to the first edge 46 of the second wall 45 when the engaging means interlock portions 30 and 40. As a result, first wall 35, first base 32, second wall 45 and second base 42 form a container with support 10 projecting therethrough when the portions 30, 40 are interlocked.

Figure 9:
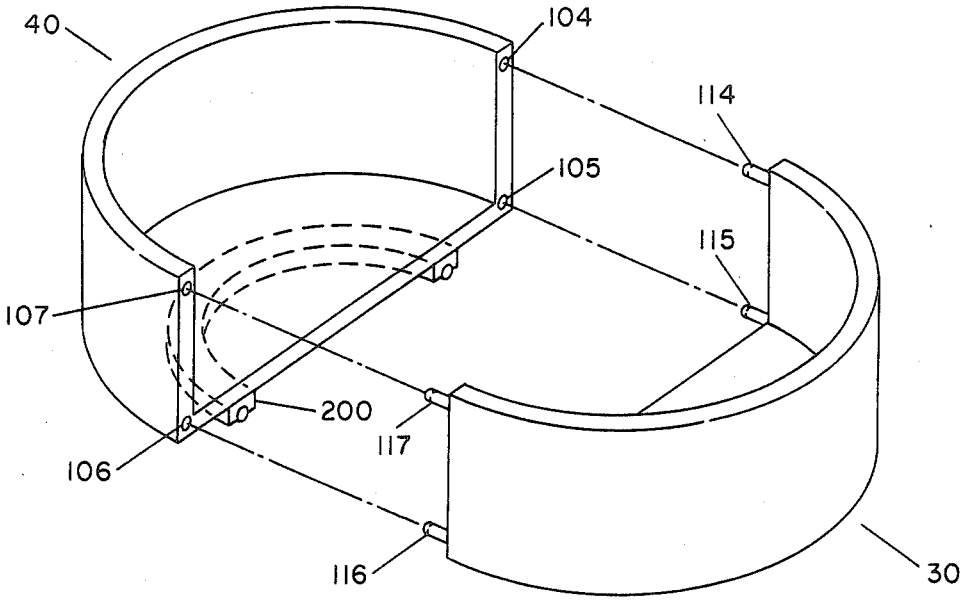
FIG. 9 is a perspective view of yet another alternate embodiment of the invention.

The second base 42 has an edge 44 forming a closure across the notch 33 of the first base 30. In the embodiment as shown in FIG. 1, the closure is actually notch 43. This traps the support 10 within the notch and between the first and second bases when the engaging means interlock portions 30 and 40. FIG. 9 is an illustration of an alternative embodiment of the article 1 according to the invention. Therein, interlocking portions 100, 110 include bases 101, 111 and outer walls 102, 112. Only base 101 is provided with a notch 103 whereas base 111 forms a closure across notch 102 in the form of edge 113.

FIG. 9 also illustrates an alternative locking means in the form of pins 114, 115, 116 and 117 and engaging holes 104, 105, 106 and 107. Also shown in FIG. 9 is bearing assembly 200. It is contemplated that the article 1 according to the invention may have bearing assembly 200 mounted to its base to facilitate rotation of article 1 about support 10. Assembly 200 would be any standard bearing structure known in the prior art such as disclosed in U.S. Pat. Nos. 3,302,549; 2,600,922; and 4,258,630; each incorporated herein by reference. In particular, assembly 200 would be a section affixed to the base of each portion of the invention. The assembly 200 would have ball bearings projecting therethrough. The bearing would contact table top 20 thereby permitting the article to be rotated about support 20.

The article 1 may also include one or more radially projecting compartmental walls 300 held in place by guides 301. Walls 300 may be located in place by sliding the wall 300 from the top downward between guides 301.

While the invention has been particularly described as a table tray, the scope of the invention is limited only by the appended claims.

What is claimed is:

1. In an article for use in combination with a vertical support such as an umbrella stand projecting through a table, the improvement comprising:

(a) first and second interlocking sections defining therebetween a closed aperture completely surrounding the support;

(b) Said first section comprising:

A first base engaging the table and having a first outer edge and a first inner edge with first means for engaging the support, said first means including a first notch centrally located therein, said first notch engaging the support; A first outer wall having a lower edge connected to the first outer edge and having first and second outer ends; A first inner wall having first and second flat sections joined by a curved section, the curved section having the same cross sectional shape as the first notch and engaging the support, said first inner wall having a lower edge connected to the first inner edge and having ends connected to the first and second outer ends of the first outer wall;

First locking means supported on the outer face of the first flat section of said first inner wall; and second locking means supported on the outer face of the second flat section of said first inner wall;

(c) Said second section comprising:

A second base engaging the table and having a second outer edge and a second inner edge with second means for engaging the support, said second means including a second notch centrally located therein, said second notch engaging the support;

A second outer wall having a lower edge connected to said second outer edge and having first and second outer ends; A second inner wall having first and second flat sections joined by a curved section, the curved section having the same cross sectional shape of the second notch and engaging the support, said second inner wall having a lower edge connected to the second inner edge and having ends connected to the first and second outer ends of the second outer wall;

third locking means supported on the outer face of the first flat section of said second wall locking with said first locking means; and Fourth locking means supported on the outer face of the second flat section of said second wall locking with said second engaging means;

(d) Said curved sections forming a channel trapping the support therebetween, the first and second locking means locking with the third and fourth locking means and the support located in the notches;

(e) Said first inner edge of said first base adjacent to the second inner edge of the second base;

(f) Said first and second outer ends of said first outer wall adjacent to the first and second outer ends of the second outer wall, respectively;

(g) Said first and second outer walls and said first and second bases forming a container with the support projecting therethrough and located in the notches.

2. The article of claim 1 further including at least one compartmental wall radially extending from the curved section of the first inner wall to the first outer wall.

3. The article of claim 2 further comprising at least one compartmental wall radially extending from the curved section of the second inner wall to the second outer wall.

4. The article of claim 3 wherein said first and third locking means each comprise a bayonnet lock projection having tapered side edges and said second and fourth locking means each comprise a bayonnet lock slot having tapered side edges, said slot for engaging said projection.

5. The article of claim 3 further including means for slidably engaging the table located between the bases and the table and supported by the bases, said means permitting rotation of the article about the support.

6. The article of claim 5 wherein said means for slidably engaging comprises a bearing assembly.

7. The article of claim 1 further comprising a third interlocking section between said first and second sections and defining therewith the closed aperture completely surrounding the support, said third section comprising:

A third base engaging the table and having a third outer edge and a third inner edge with third means for engaging the support, said third means including a third notch centrally located therein, said third notch engaging the support;

A third outer wall having a lower edge connected to the third outer edge and having first and second outer ends;

A third inner wall having first and second flat sections joined by a curved section, the curved section having the same cross sectional shape as the third notch and engaging the support, said third inner wall having a lower edge connected to the third inner edge and having ends connected to the first and second outer ends of the third outer wall;

fifth locking means supported on the outer face of the first flat section of said third inner wall; and sixth locking means supported on the outer face of the second flat section of said third inner wall; and wherein:

(d) Said curved sections form a channel trapping the support therebetween, the fifth and sixth locking means locking with the first and fourth locking means and the support located in the notches;

(e) Said first, second and third outer walls and said first, second and third bases forming a container with the support projecting therethrough and located in the notches.

* * * * *